United States Patent [19]

Kutchin

[11] Patent Number: 4,784,261

[45] Date of Patent: Nov. 15, 1988

[54] MULTIPLE UNIT CIGARETTE PACKAGE

[76] Inventor: Sidney W. Kutchin, 115 Astor St., Apt. 39W, Chicago, Ill. 60610

[21] Appl. No.: 85,559

[22] Filed: Aug. 17, 1987

[51] Int. Cl.[4] ..... B65D 75/38

[52] U.S. Cl. ..... 206/256; 206/271; 206/459

[58] Field of Search ..... 40/312; 206/45.33, 45.34, 206/232, 247, 256–258, 264, 271, 273, 274, 459, 831

[56] References Cited

U.S. PATENT DOCUMENTS

| | | | |
|---|---|---|---|
| 1,923,452 | 8/1933 | Nemiller | 206/45.33 |
| 2,115,021 | 4/1938 | Joffee | 206/459 |
| 2,158,971 | 5/1939 | Stratton | 206/258 |
| 3,051,305 | 8/1962 | Houle | 206/264 |
| 3,058,581 | 10/1962 | Keating | 206/256 |
| 3,148,768 | 9/1964 | Gatto | 206/256 |
| 3,226,010 | 12/1965 | Rogers | 206/256 |
| 3,695,422 | 10/1972 | Tripodi | 206/831 |
| 3,809,227 | 5/1974 | Begemann | 206/264 |

*Primary Examiner*—Jimmy G. Foster

*Attorney, Agent, or Firm*—Hill, Van Santen, Steadman & Simpson

[57] ABSTRACT

A cigarette package is provided having a desired number of individual packets which are wrapped by a clear cellophane wrapper to provide a single package. Each of the individual packets contains a predetermined quantity of cigarettes. An advertising card is provided between the individual packets which in turn forms a part of the completed package upon wrapping of the package itself.

1 Claim, 1 Drawing Sheet

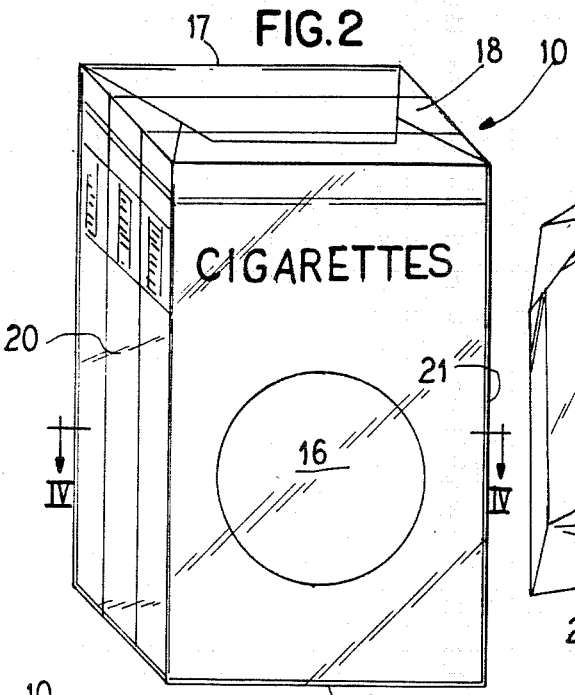
FIG. 2
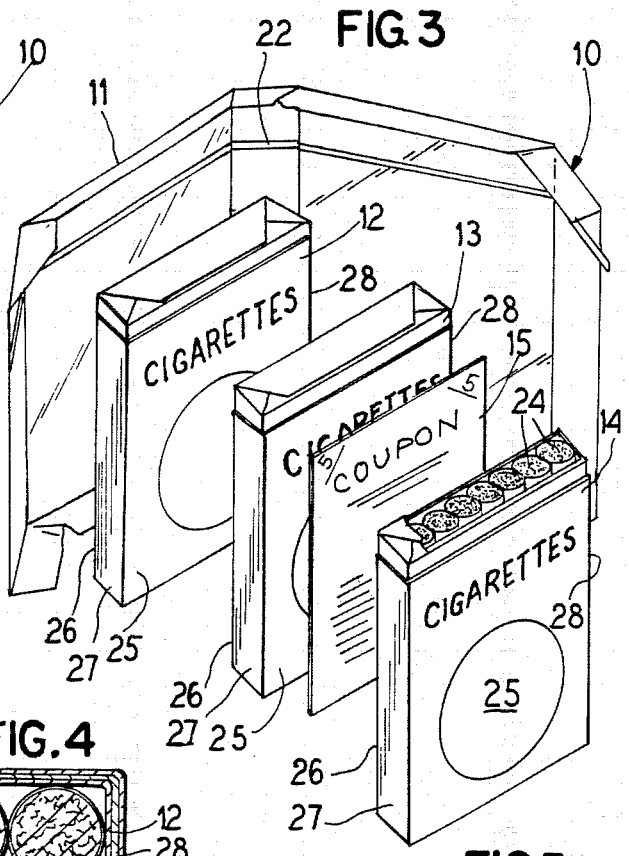
FIG. 3
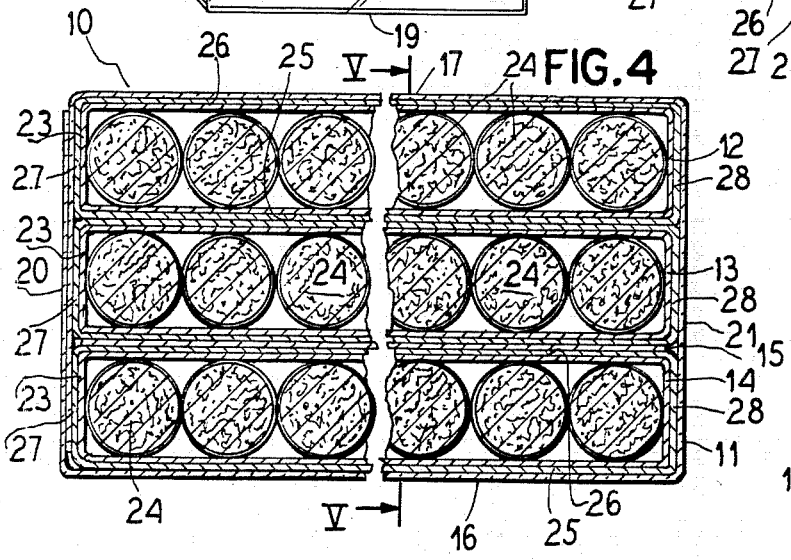
FIG. 4
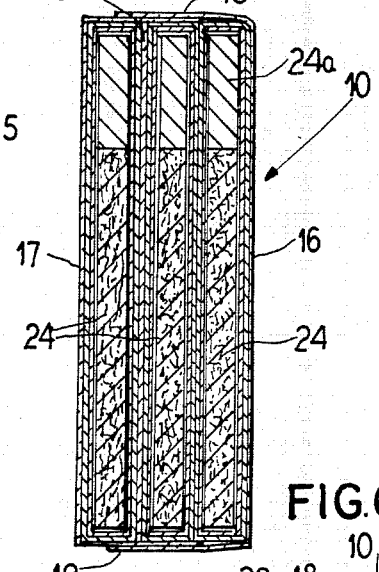
FIG. 5
(PRIOR ART) FIG. 1
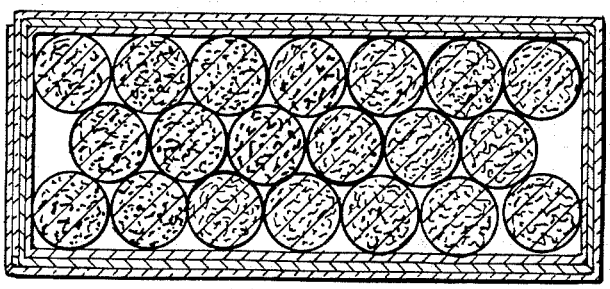
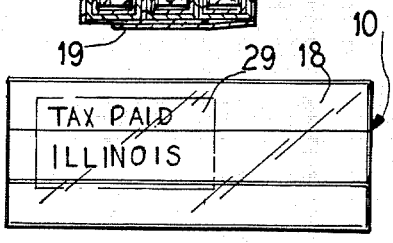
FIG. 6

MULTIPLE UNIT CIGARETTE PACKAGE

FIELD OF THE INVENTION

This invention relates to the art of cigarette packaging a plurality of individual packets in an easily opened display wrapper providing a customer with a choice of purchasing individual packets and/or the entire package and preserving unopened packets.

PRIOR ART

Existing cigarette packages consist of a rectangular shaped package or box having a quantity of cigarettes contained within its interior and are wrapped by a clear cellophane wrapper. Most prior art packages contain 20 cigarettes which are arranged in three rows of 7, 6 and 7 cigarettes respectively.

The cigarette as a product is oftentimes targeted by governmental agencies for imposition of taxes in the nature of "sin taxes", particularly in the period of time since the Surgeon General of the United States has held that cigarette smoking can be dangerous to one's health. Thus, the cost of the average 20 pack container of Class A cigarettes has greatly increased and the number of smokers has either decreased or, those that do smoke, prefer to smoke a lesser number of cigarettes.

SUMMARY OF THE INVENTION

According to this invention there is provided a cigarette package having three separate packets unitarily packed in the usual clear cellophane wrapper. Each packet is individually labelled as a stand-alone unit, thereby repeating the advertising impact of the trademark. The package may also contain an advertising card or coupon interleaved between one or more of the individual packets. The wrapper itself may be provided with a tear-away strip near its top surface for providing easy access through the cellophane wrapper to the individual packets, thereby affording optional utilitarian usage of the packets.

Only one packet within the package needs to be opened at a time, thereby keeping the cigarettes in the other two opened packets fresh and salable as a stand-alone unit.

BRIEF DESCRIPTION OF THE DRAWINGS

Best mode embodiments of the invention are shown in the attached sheets of drawings in which:

FIG. 1 is a transverse sectional view of a prior art cigarette package;

FIG. 2 is a perspective view of the cigarette package of this invention;

FIG. 3 is an exploded perspective view of the cigarette package of FIG. 2 illustrating the components of the cigarette package;

FIG. 4 is an enlarged broken cross-sectional view along lines IV—IV of FIG. 2;

FIG. 5 is a longitudinal sectional view of the cigarette package of the present invention along lines V—V of FIG. 4; and FIG. 6 is a top plan view of the cigarette package of FIG. 2.

DESCRIPTION OF THE PREFERRED EMBODIMENT

The usual conventional cigarette package of the prior art measures approximately $2'' \times 3\frac{3}{8}'' \times \frac{7}{8} \times$ [51.3 mm × 86.5 mm × 22.4 mm] and is sized to conveniently fit in the shirt pocket of a man or to be received in the purse of a woman. The so-called "100's" or "slims" package measures $2''4'' \times \frac{7}{8}$ [51.3 mm × 102.6 mm × 22.4 mm].

In accordance with the principles of the present invention, it is contemplated that there be provided a unitary package which will be very nearly the same size, if not identically sized, as a conventional cigarette package, but wherein the contents of the package are independently wrapped as three stand-alone units so they can be sold separately, or together, and so they can be used selectively by the ultimate purchaser.

The usual prior art conventional package is shown in section in FIG. 1. A so-called "20 pack" Class A cigarette packaging format is employed so that there are 3 rows with the outer rows having 7 cigarettes each and the middle row has 6 cigarettes nested between the outer rows.

FIGS. 2–6 disclose a cigarette package 10 of the present invention having a transparent outer wrapper 11, three individual packets 12, 13 and 14 and with an insert advertising card or coupon 15.

The cigarette package 10 is rectangular in shape having a front side 16 and a rear side 17 along with a top 18 and a bottom 19, a side 20 and a side 21.

The transparent outer wrapper 11 may be made from a variety of transparent, tearable sheet materials and in the illustrated exemplary embodiment is made from cellophane. The wrapper 11 wraps around the three individual packets 12, 13 and 14 and is sealed on the top portion 18, the bottom portion 19 and the side portion 20. The sealing may be accomplished in a variety of ways including an adhesive, heat sealing or tape. Additionally, the wrapper 11 may have a tear-strip or pull string 22 near the top portion 18 of the package 10 which enables a user to quickly and precisely open the wrapper 11 thereby exposing only the tops of the individual packets 12, 13 and 14 without destroying the integrity of the remaining portion of the wrapper 11.

Each of the individual packets 12, 13 and 14 are constructed as stand-alone independent packets. Thus, a foil backed paper 23 seals each packet 12, 13 and 14 and is readily openable. For uniformity, each of the packets 12, 13 and 14 have a quantity of seven cigarettes 24 contained within their interiors. In each of the packets 12, 13 and 14 the seven cigarettes are arranged side by side in a straight line so that each packet has a thin, relatively flat rectangular shape. As FIG. 5 shows, each of these cigarettes 24 may, if desired, contain a filter portion **24*a*** near one end.

The package 10 is intended to be sold and distributed as a unitary package or in a carton of ten packs in the same manner as the prior art package shown in FIG. 1. Although the package 10 of the present invention conceivably could vary slightly from the package of the prior art, such differences are intended to be minimized so that conventional packaging and handling machinery would be used to the full extent possible. A retailer or an ultimate user may remove the top of the wrapper 11 by pulling the tear-strip 22 and exposing the tops of each individual packet 12, 13 and 14. Thereafter, one of the packets 12, 13 and 14 may be either sold separately or opened individually to remove a cigarette 24 while the remaining packets remain sealed.

Since the package 10 may be entirely separated into three stand-alone packets 12, 13 and 14, a retailer may sell cigarettes in smaller quantities for consumers who may only desire such a smaller quantity and allows a user to carry a smaller package if he desires. Due to the integrity of each packet 12, 13 and 14, the packet 10 may be separated without damage to the cigarettes 24.

Due to the arrangement of the cigarettes 24 within each of the packets 12, 13 and 14, a front side 25 and back side 26 of each of the packets is formed having relatively large surface areas corresponding to the conventional display surfaces of a prior art package. Thus, each of the front and back surfaces 25 and 26 may contain a desired amount of trade dress such as advertising, trademarks and logos by means of which a manufacturer provides advertising messages. Furthermore, each of the packets 12, 13 and 14 have a side 27 and a side 28 which are sufficiently wide enough to include any necessary warnings, bar codes, address of the manufacturer or any other desired information. By having essentially the same trade dress on the stand-alone packets 12, 13 and 14 the same trade dress for the complete integrated package 10 is repeated on each packet.

As illustrated in FIG. 3, an advertising card or coupon 15 may be provided between the packets 12, 13 and 14. The coupon 15 is then enclosed within the package 10 upon wrapping of the wrapper 11 around the individual packets 12, 13 and 14. The coupon 15 enables a manufacturer to provided special merchandising programs in addition to having separate advertising carriers in each full sized package.

FIG. 6 illustrates a tax stamp 29 which may be placed on the exterior of the wrapper 11 on the top side 18 of the cigarette package 10. This tax stamp 29 is required in the majority of, if not all of the states to indicate that the appropriate tax has been paid on such items. Alternatively, the tax stamp 29 may be placed under the wrapper 11 and span the top of each packet 12, 13 and 14 so that if the package 10 is separated, each packet 12, 13 and 14 will contain a portion of the stamp.

As in apparent from the foregoing specification, the invention is susceptible of being embodies with various alterations and modifications which may differ particularly from those that have been described in the preceeding specification and description. It should be understood that we wish to embody within the scope of the patent warranted hereon all such modifications as reasonably and properly come within the scope of our contribution to the art.

I claim:

1. A cigarette package comprising:

a transparent outer wrapper made of transparent tearable sheet cellophane sealed on a top portion, a bottom portion and a side portion and including:

a tear strip near the top portion of the package to enable the user to quickly and precisely tear away the top sealed portion of the cellophane thereby exposing the contents of the outer wrapper without destroying the integrity of the remaining portion of the outer wrapper;

three individual packets formed as independent stand-along independent packages in said outer wrapper, each packet comprising a foil backed paper sealing seven cigarettes arranged side-by-side in a straight line so that each packet has a relatively flat rectangular shape, a tear strip in the top portion of each individual packet, whereby the user may selectively remove the top of each individual packet by tearing away the corresponding foil backed paper;

a front face and a back face on parallel opposite sides of each packet and forming large surface areas corresponding to conventional display surfaces on a conventional 20 pack cigarette package and adapted to carry advertising trademarks and logos by means of which the manufacturer provides advertising messages;

side surfaces on opposite parallel sides of each packet of sufficient width to accommodate the thickness of a row of cigarettes and forming display surfaces to carry warnings, bar codes and other information; and at least one advertising coupon card between the packets to provide a two-sided indicia-bearing front and rear faces of a size commensurate with said front and back faces to enable the manufacturer to provide selective advertising and promotional messages, whereby there is provided a cigarette package having three separate packets unitarily packed in a clear cellophane wrapper and wherein each packet is individually labeled as a stand-alone unit to afford optional utilitarian usage of the packets.

* * * * *

UNITED STATES PATENT AND TRADEMARK OFFICE

CERTIFICATE OF CORRECTION

PATENT NO. : 4,784,261

DATED : November 15, 1988

INVENTOR(S) : Sidney W. Kutchin

It is certified that error appears in the above-identified patent and that said Letters Patent is hereby corrected as shown below:

On the title page, Item [76] in the inventor's address:

"115 Astor St.," should read --155 Astor St.,--

Column 1, line 43, "opened" should read --unopened--.

Column 1, line 67, "7/8 X [51.3" should read --7/8" [51.3--.

Column 2, line 3, " 2"4" X 7/8 [51.3 " should read --2" X 4" X 7/8" [51.3--.

Column 3, line 27, "provided" should read --provide--.

Column 3, line 40, before "apparent," "in" should read --is--.

Column 3, line 41, "embodies" should read --embodied--.

Signed and Sealed this

Twentieth Day of February, 1990

*Attest:*

JEFFREY M. SAMUELS

*Attesting Officer* *Acting Commissioner of Patents and Trademarks*